US006315280B1

(12) United States Patent
Jang

(10) Patent No.: US 6,315,280 B1
(45) Date of Patent: Nov. 13, 2001

(54) PAPER FEEDING APPARATUS OF A MULTI-FUNCTIONAL MACHINE

(75) Inventor: Heung-Kyu Jang, Kyungki-do (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/487,905

(22) Filed: Jan. 19, 2000

(30) Foreign Application Priority Data

Jan. 19, 1999 (KR) ..... 99-1408

(51) Int. Cl.[7] ..... B65H 3/44; B65H 5/26

(52) U.S. Cl. ..... 271/9.02; 271/9.07; 271/9.08; 271/9.11

(58) Field of Search ..... 271/9.01, 9.02, 271/9.03, 9.04, 9.07, 9.08, 9.11

(56) References Cited

U.S. PATENT DOCUMENTS 4,991,830 * 2/1991 Yamanaka ..... 271/9.08
5,695,182 * 12/1997 Sekine ..... 271/9.69
6,227,533 * 5/2001 Jang ..... 271/9.11

FOREIGN PATENT DOCUMENTS

405124739 A * 5/1993 (JP) ..... 271/9.07

* cited by examiner

*Primary Examiner*—H. Grant Skaggs
(74) *Attorney, Agent, or Firm*—Robert E. Bushnell, Esq.

(57) ABSTRACT

A paper feeding apparatus of a multi-functional machine capable of automatically feeding documents and printable paper one by one is provided. The paper feeding apparatus includes a sensor for sensing whether the documents are loaded, a separating unit for separating the picked-up documents or print papers by piece, and a lever moved up in the standby state so that a plurality of documents can be stacked and moved down when the document is picked up by a pick-up roller in order to automatically transfer all the loaded documents and the printable paper.

22 Claims, 5 Drawing Sheets

PAPER FEEDING APPARATUS OF A MULTI-FUNCTIONAL MACHINE

CLAIM OF PRIORITY

This application makes reference to, incorporates the same herein, and claims all benefits accruing under 35 U.S.C. §§119 from an application for Paper Feeding Apparatus of a Multi-functional Machine earlier filed in the Korean Industrial Property Office on Jan. 19, 1999 and there duly assigned Serial No. 1999-1408.

BACKGROUND OF THE INVENTION

1. Field of the Invention

This invention relates to a paper feeding apparatus transferring a document and sheets of printable paper into a multi-functional machine along the same transfer path and more specifically, to automatically feed all documents and sheets of paper into the multi-functional machine.

2. Description of the Related Art

A multi-functional machine has been improved to include functions of various office automated machines such as a printer printing data processed in a computer on a printable paper, a copying machine copying a document, and a facsimile machine transmitting data of documents to the other machine. Typically, in a multi-functional machine having the functions of such office automated machines, a document feeding unit for supplying documents and a paper feeding unit for supplying papers are separately and independently installed in a paper feeding apparatus of the multi-functional machine.

The multi-functional machine, however, becomes more complicated and more expensive to accommodate the installation of both a document feeding unit and a paper feeding unit in a paper feeding apparatus because the two feeding units having their own feeding paths in the paper feeding apparatus cause the paper feeding apparatus to be more complicated, and the complexity of the paper feeding apparatus requires the bigger and more expensive multi-functional machine.

Efforts to produce a less expensive and smaller multi-functional machine have been used to develop a paper feeding apparatus in which a document feeding unit supplying documents and a paper feeding unit supplying a printable paper share a common feeding path. This paper feeding apparatus requires a user to supply documents one by one when the documents are loaded in the document feeding unit of the paper feeding apparatus. I have noticed that it is inconvenient and time-consuming for the user to load a document in the document feeding unit and supply the documents one by one until all documents are fed into the multi-functional machine.

SUMMARY OF THE INVENTION

It is an object of the present invention to provide an improved paper feeding apparatus with a document feeding unit feeding a document and a paper feeding unit feeding a recordable sheet of paper.

It is another object to provide a paper feeding apparatus in which a document feeding unit shares a common feeding path with a paper feeding unit.

It is yet another object to provide a paper feeding apparatus capable of allowing all documents to be stacked in a document feeding unit.

It is still another object to provide a paper feeding apparatus suitable to automatically feed all documents stacked in a document feeding unit one by one into a multi-functional machine.

It is a further object to provide a paper feeding apparatus capable of allowing all documents to be stacked in a document feeding unit and sheets of paper to be loaded in a paper feeding unit.

It is also an object to provide a paper feeding apparatus capable of automatically feeding sheets of paper loaded in a paper feeding unit after automatically feeding all document stacked in a document feeding unit one by one into multi-functional machine.

These and other objects may be achieved by providing a paper feeding apparatus including a pick-up roller picking up the documents and the printable paper, an automatic printable paper feeding unit installed in a feeding frame and including a printable paper feeding plate on which the printable paper is loaded and a feeding plate controller moving the printable paper feeding plate toward the pick-up roller when the printable paper is needed to be picked up, a document feeding unit installed over the automatic printable paper feeding unit and including a document feeding plate formed in such a manner that the document feeding plate does not interfere with the pick-up roller and the printable paper when the printable paper is picked up and that the document feeding plate does not have to be relocated in order to allow the printable paper and the documents to be fed, a sensor for sensing whether the document is loaded or not in the document feeding unit, a separating unit separating the picked-up documents or printable paper one by one, and a lever moving between a standby state and a pick-up state so that a plurality of documents are stacked in the standby state and that the documents are picked up by the pick-up roller in the pick-up state.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
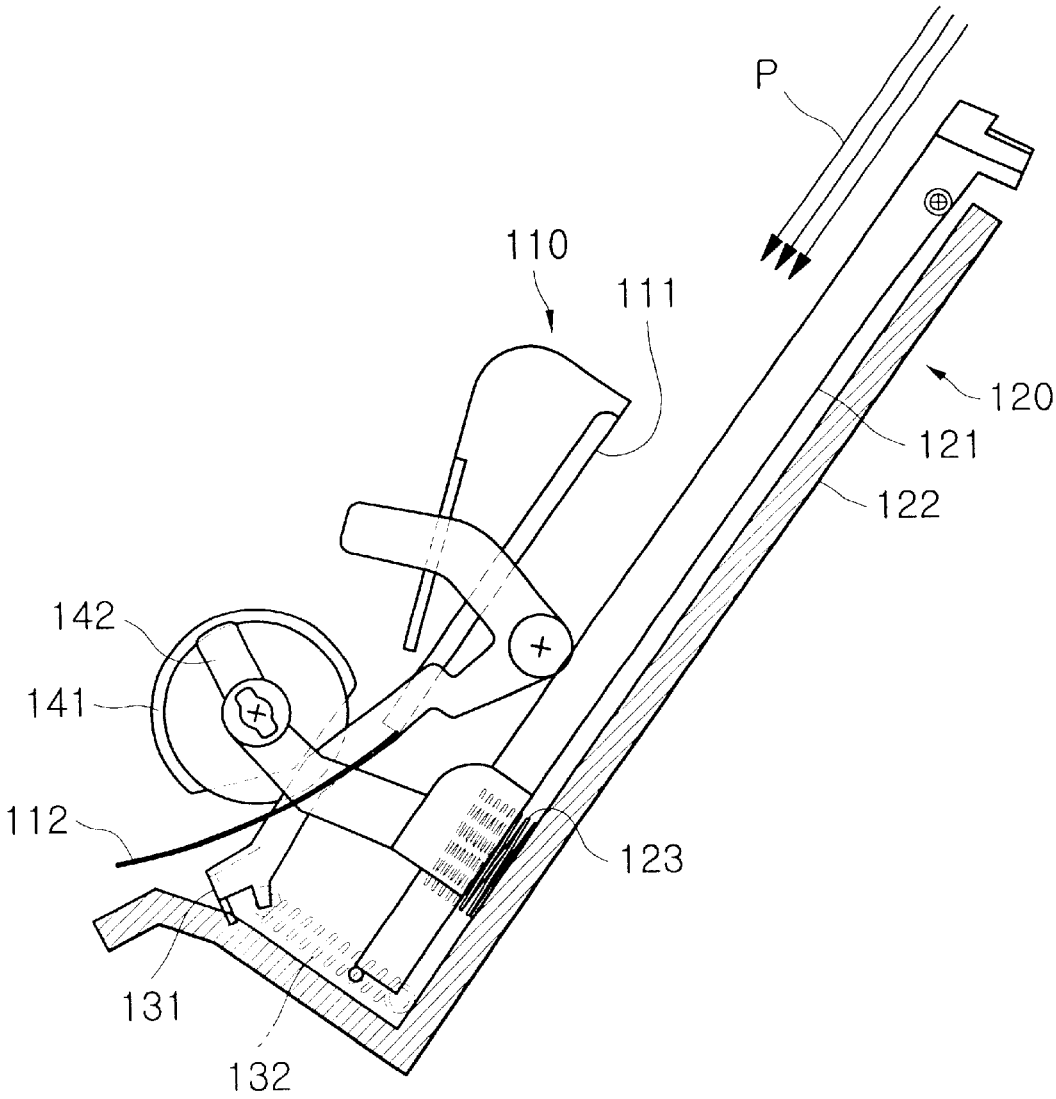
FIG. 1 (Prior art)
FIG. 1 is a cross sectional view illustrating a standby state of a paper feeding apparatus of a multi-functional machine.
Figure 2:
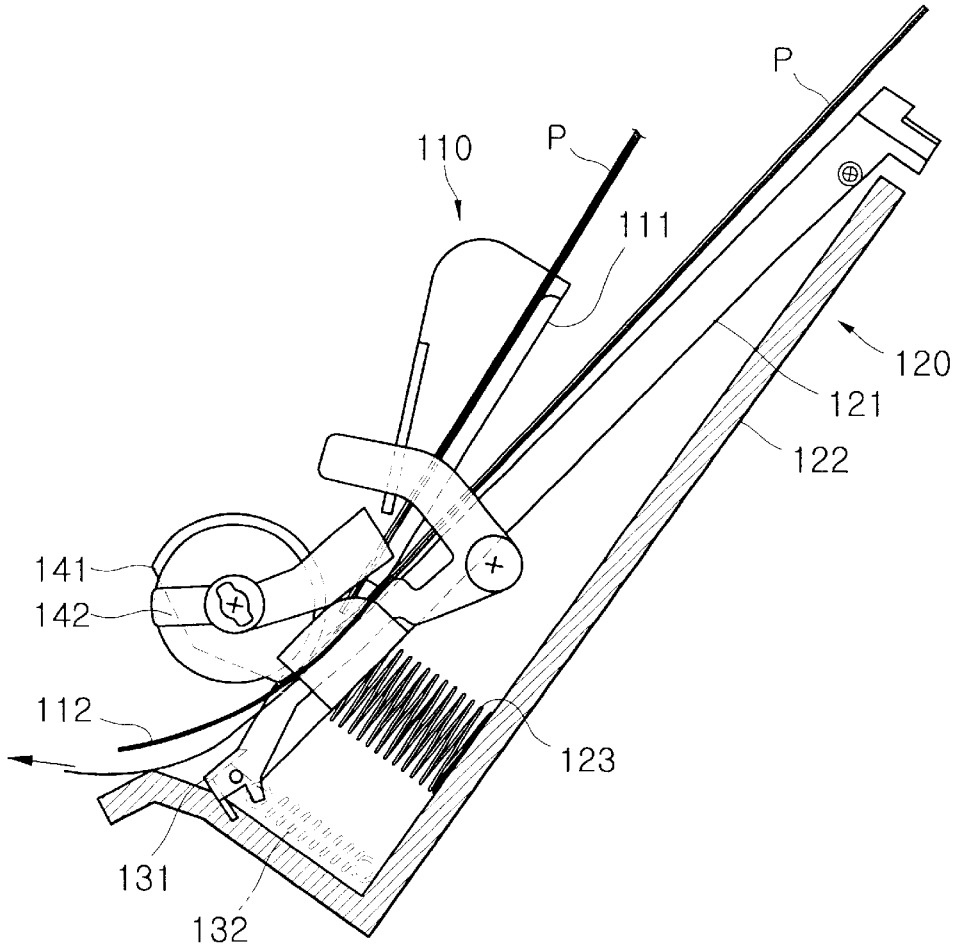
FIG. 2 (Prior art)
FIG. 2 is a cross sectional view illustrating the paper pick-up state of a paper feeding apparatus of the multi-functional machine.
Figure 3:
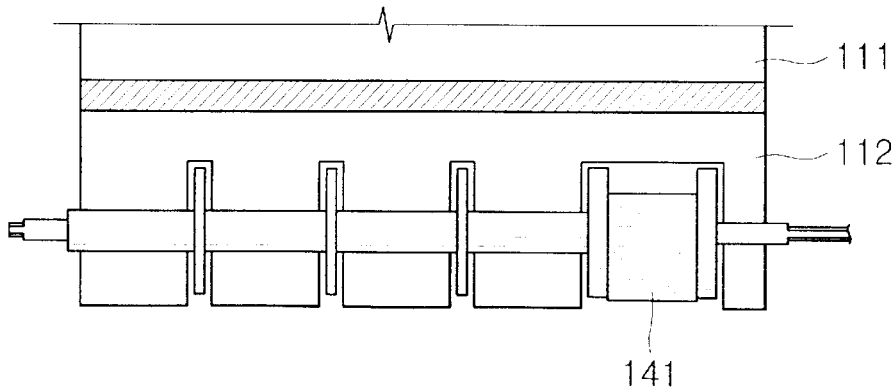
FIG. 3 (Prior art)
FIG. 3 illustrates a guide film applied to a manual document feeding unit of FIG. 1.

Turning now to FIGS. 1 through 3, a printable paper unit 120 and a document feeding unit 110 are installed in a multi-functional machine not shown. A plurality of sheets of printable paper P are loaded on a paper feeding plate 121 of printable paper unit 120. A document D is loaded on a document feeding plate 111 of document feeding unit 110.

Document feeding plate 111 on which document D is loaded is cut away at a bottom portion thereof, and a guide film 112 of a thin film material is attached to the bottom portion of document feeding plate 111 and extends to the length of the cut away portion of document feeding plate 111. A finger 131 is disposed to separate printable paper P supplied from printable paper feeding unit 120 one by one. Guide film 112 is located between printable paper feeding plate 121 loading printable paper P thereon and a pick-up roller 141 picking up the printable paper loaded on paper feeding plate 121. Accordingly, when a document D is picked up by pick-up roller 141, a friction area between the printable paper and the pick-up roller 141 can be avoided by guide film 112.

Although guide film 112 extends from an end of the document feeding plate 111 as described above, guide film 112 is not needed if document feeding plate 111 does not interfere with pick-up roller 141 and printable paper P when printable paper P is picked up. In other words, the same efficiency can be obtained by partially removing the bottom portion of the document feeding plate 111 without using the guide film 112.

In the standby state as shown in FIG. 1, paper feeding plate 121 of print paper feeding unit 120 is pressed by a pick-up cam 142, and a finger 131 is moved up by an elasticity of a finger spring 132 having one end fixed to a feeding frame 122. When a user loads sheets of printable paper on paper feeding plate 121 and inputs a printing command into the multi-functional machine in the standby state, a sheet P is picked up by pick-up roller 141 so that data formed in a computer or scanned from a document is printed on the sheet of paper.

D-shaped pick-up roller 141 rotates in clockwise direction, and pick-up cam 142 rotating together with the pick-up roller 141 releases paper feeding plate 121. Paper feeding plate 121 is pushed by the elasticity of a knock-up spring 123 and moves toward pick-up roller 141 and to an automatic pick-up state as shown in FIG. 2. Therefore, printable paper P picked up by pick-up roller 141 is passed through a space between pick-up roller 141 and finger 131 and transferred into the multi-functional machine.

When a document D is loaded on document feeding plate 111 of document feeding unit 110, and a scanning command is input into the multi-functional machine by a user in the standby state, the pick-up roller 141 rotates in clockwise direction, and pick-up cam 142 that rotates in clockwise direction together with the pick-up roller 141 releases feeding plate 121. The elasticity of knock-up spring 123 pushes paper feeding plate 121 toward pick-up roller 14. Paper feeding unit 120 is set to the automatic pick-up state as shown in FIG. 2.

If a document D is loaded on document feeding plate when printable paper P is loaded on paper feeding plate 121, document P is picked up by pick-up roller 141, and the picked-up document D is scanned by a scanner not shown. The scanned document data is temporarily stored in a central processing unit (CPU) not shown. Thereafter, when a copying command is input by a user into the multi-functional machine, pick-up roller 141 picks up printable paper P loaded on paper feeding plate 121 of print paper feeding unit 120.

In this multi-functional machine, documents D are loaded on document feeding plate 111 one by one, and a loaded document is fed by pick-up roller 141. A sheet of printable paper P is picked up by pick-up roller 141 after a document D is picked up, fed by pick-up roller 141 into the multi-functional machine and scanned by the scanner located within the multi-functional machine. Therefore, in a case that a great number of documents need to be scanned, the user should supply the documents by piece until the scanning is completed. It is very inconvenience for the user to load all the documents one by one on document feeding plate 111.

Figure 4:
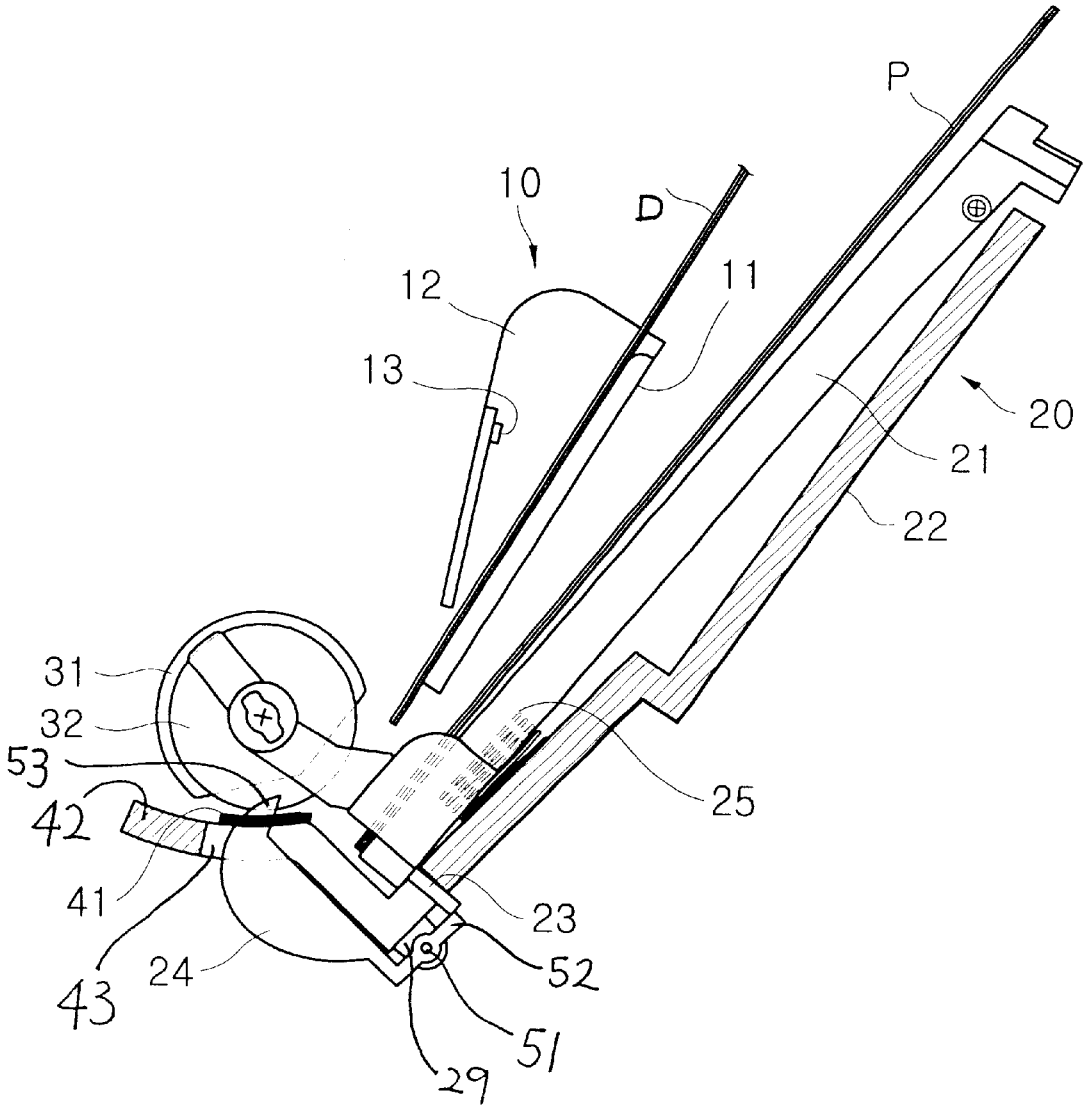
FIG. 4 is a cross sectional view illustrating the standby state of a paper feeding apparatus of a multi-functional machine according to the present invention.
Figure 5:
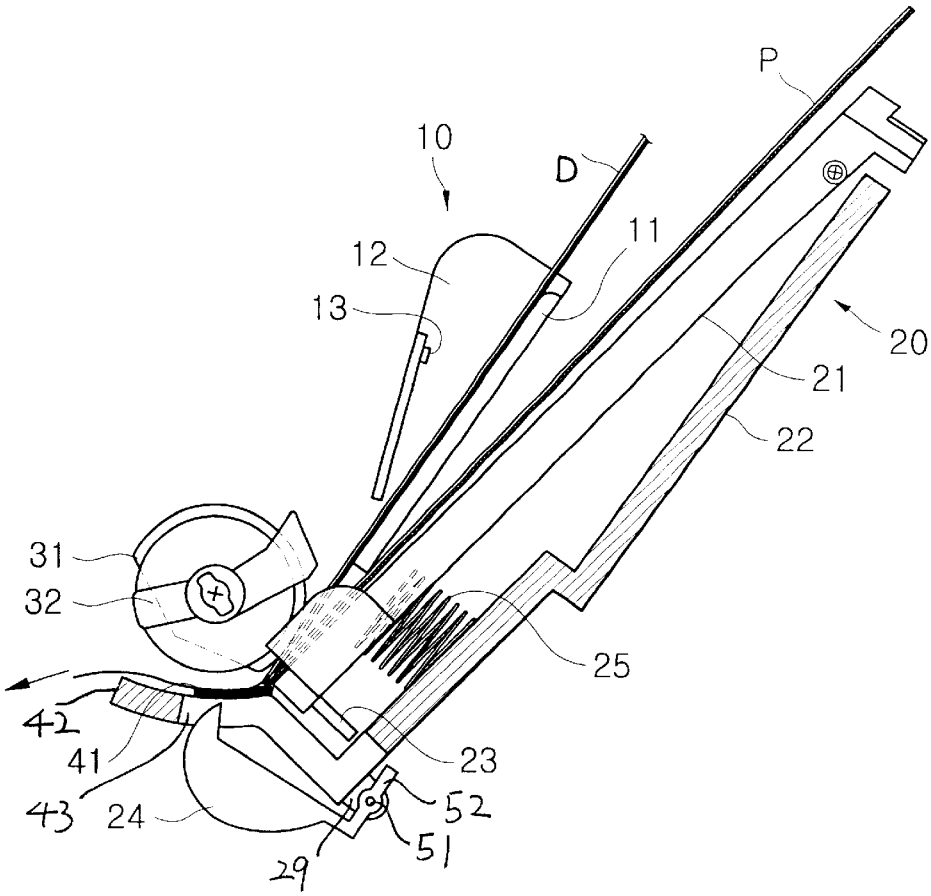
FIG. 5 is a cross sectional view illustrating the paper pick-up state of a paper feeding apparatus of a multi-functional machine according to the present invention.
Figure 6:
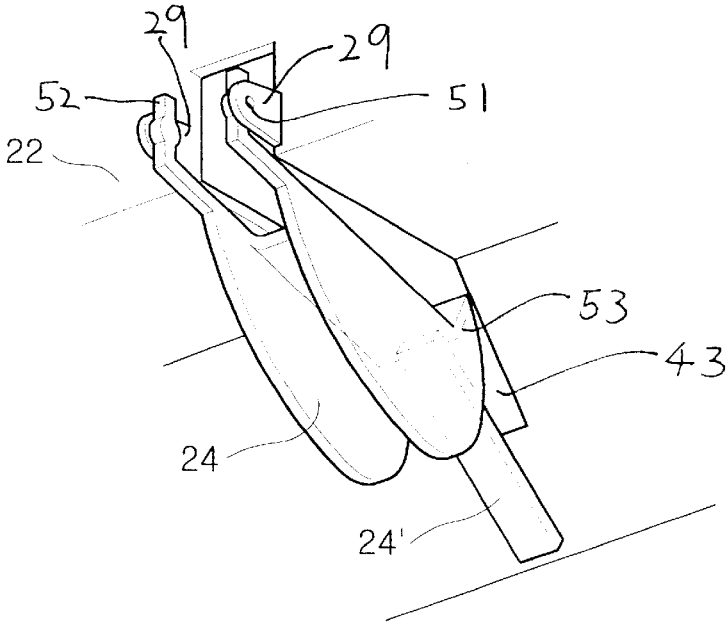
FIG. 6 is a perspective view illustrating a lever of FIGS. 4 and 5.

In an embodiment of a paper feeding apparatus of a multi-functional machine according to the present invention will be described more fully hereinafter with reference to the accompanying drawings. FIGS. 4 and 5 illustrate a paper feeding apparatus of a multi-functional machine according to the present invention, and FIG. 6 shows a perspective view of a lever 24 of FIGS. 4 and 5.

A document feeding unit 10 includes a document guide 12 and a photo sensor 13 installed on document guide 12 and sensing whether a document D is loaded on a document feeding plate 11. As shown in FIG. 6, a return lever 24 is installed to hinge on a bottom of a feeding frame 22 on which a print paper feeding plate 21 of a print paper feeding unit 20 is installed. A shaft 51 of return lever 24 is inserted into a plurality of holes formed on supporters 29 protruded from feeding frame 22.

A projection 23 attached to a bottom of paper feeding plate 21 is disposed to operate an extension 52 of return lever 24. When paper feeding plate is in a standby state and is moved down, projection 23 presses extension 52, and lever 24 rotates about an axis of shaft 51 in the clockwise direction. When paper feeding plate is pushed up and projection 23 moves upward, projection 23 does not press extension 52 any more, return lever 24 rotates about shaft 51 in the counter clockwise by a wight of return lever 24. A protrusion 53 extended from lever 24 is inserted into an opening 43 formed on feeding frame 22. A friction pad 41 is attached to a guide plate 42. Friction pad 41 or a finger not shown is installed under pick-up roller 31 in order to transfer documents or printable paper picked up by a pick-up roller 31 one sheet by one sheet. A stopper 24' limits the rotation of lever 24.

In the standby state that feeding plate 21 of print paper feeding unit 20 is pressed by a pick-up cam 32 as shown in FIG. 4, feeding plate 21 is moved toward the feeding frame 22. Accordingly, extension 52 of return lever 24 is pressed by the projection 23, and lever 24 rotates in the clockwise direction. When sheets of printable paper P are loaded on feeding plate 21 by a user in the standby state and are stacked in a position lower than protrusion 53 of lever 24. Thereafter, when a printing command is input by the user into the multi-functional machine, pick-up roller 31 rotates in the clockwise direction, and feeding plate 21 moves by the elasticity of knock-up spring 25 in accordance with the rotation of pickup cam 32. As a result, the state of the paper feeding apparatus is changed into the automatic pick-up state. At the same time, lever 24 rotates in the counter clockwise direction and protrusion 53 of return lever 24 moves down through opening 43 by its own dead weight until stopper 24' contacts the protrusion 53 of return lever 24 in order to stop the rotation of lever 24 as shown in FIG. 5. In this state, sheet of printable paper is transferred by pick-up roller 31. Therefore, printable paper P picked up by prick-up roller 31 passes through the space between pick-up roller 31 and friction pad 41. By repeatedly performing the above described operation, sheets of printable paper are automatically supplied into the multi-functional machine.

If a plurality of documents D are loaded on document feeding plate 11 of document feeding unit 10 in the standby state as shown in FIG. 4 after sheets of printable paper P are loaded on feeding plate 21, documents D loaded on document feeding plate 11 is sensed by photo sensor 13. A document sensing signal generated from photo sensor 13 is transmitted to a central processing unit CPU not shown. The CPU proceeds a document scanning state in accordance with a reception of the document sensing signal, operates a scanner not shown, and performs document feeding operation in the same manner as printable paper feeding operation.

Figure 7A:
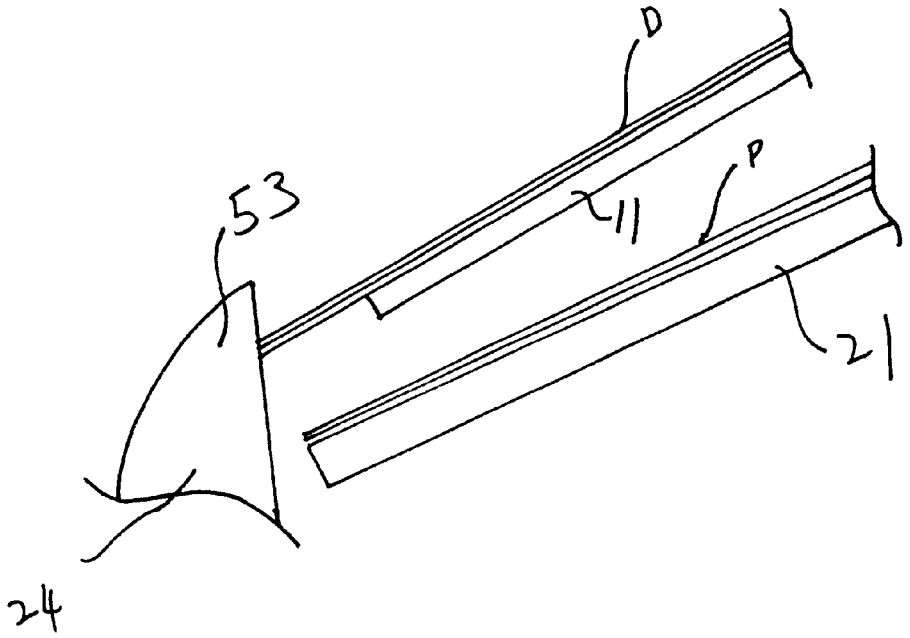
FIGS. 7A and 7B is partial cross-sectional views showing a plurality of documents and printable paper stacked by a lever on a document feeding plate and paper feeding plate respectively.
Figure 7B:
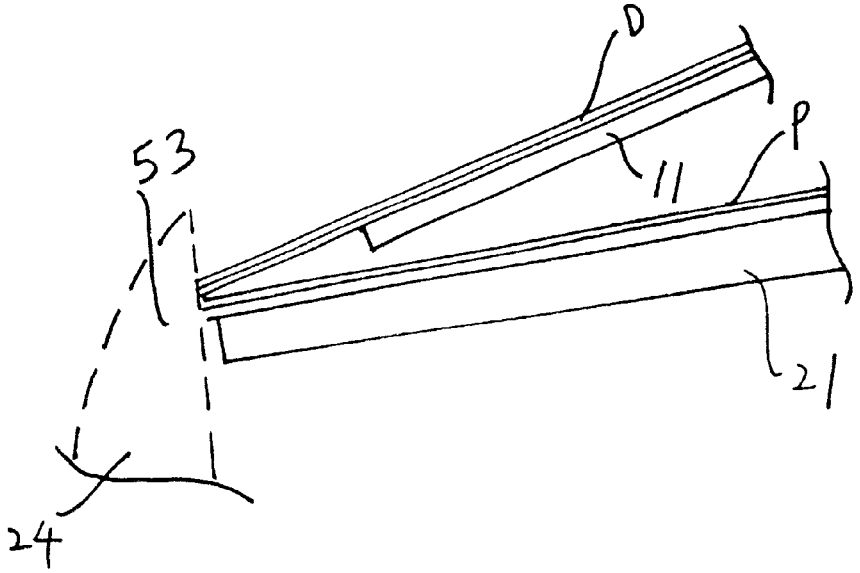

When documents D are loaded on document feeding plate 11 in the standby state, documents D loaded on document feeding plate 11, sheets of printable paper loaded on paper feeding plate 21 are stacked and arranged by protrusion 53 of lever 24 as shown in FIG. 7A. Under this condition, photo sensor 13 senses the loaded documents and transmits the document sensing signal to the CPU. Then, the CPU rotates the pick-up roller 31 in clockwise direction and operates the scanner in response to a scanning command. Paper feeding plate 21 is moved up by the elasticity of knock-up spring 25, paper feeding unit 20 becomes in the automatic paper pick-up state. When lever 24 rotates, protrusion 53 of lever 24 is pulled out from opening 42 of feeding frame 22 so that documents D and printable paper P can be transferred. When paper feeding plate 21 is raised toward pick-up roller 31 by the rotation of pick-up cam 32 and knock up spring 23, printable paper P is located under documents D as shown in FIGS. 5 and 7B. Accordingly, document D is picked-up when pick-up roller 31 rotates, and the picked-up document D is transferred through the space between pick-up roller 31 and friction pad 41 and fed into the multi-functional machine through guide plate 42. The picked-up documents D are scanned by the scanner and the scanned data is temporarily stored in the CPU. After all documents D located on printable paper are picked-up and fed into the multi-functional machine, the printable paper is disposed to contact pick-up roller 3 1 and picked up by pick-up roller 31.

By repeatedly performing the above-described operation, all documents D are stacked by return lever 24 and automatically picked up by pick-up roller 31 and supplied into the multi-functional machine. When documents D are completely supplied and a copying command is input into the multi-functional machine, printable paper P is automatically picked up by pick-up roller 31 and fed into the multi-functional machine, and copying operation is performed in the multi-functional machine.

As described above, according to the principles of the present invention, it is very convenience for an user to automatically supply all the documents stacked on the document feeding plate and the printable paper loaded in paper feeding unit after all the document have been fed into the multi-functional machine. Moreover, a lever inserted into an opening formed on feeding frame allows the document loaded on the document feeding plate of the document feeding unit to be stacked above the printable paper loaded on the paper.

This invention has been described above with reference to the aforementioned embodiments. It is evident, however, that may alternatives, modifications and variations will be apparent to those having skill in the art in light of the foregoing description. Accordingly, the present invention embraces all such alternatives, modifications and variations as fall within the spirit and scope of the appended claims and their equivalents.

What is claimed is:

1. A paper feeding apparatus in a multi-functional machine, comprising:

a paper unit disposed in a frame to move between a feeding position and a loading position, accommodating sheets of printable paper during said loading position, having a projection moving with said paper unit;

a document unit fixed to said frame, disposed to accommodate a plurality of documents;

a lever disposed on said frame to contact said projection and rotate by the movement of said projection of said paper unit, a protrusion formed on said lever, allowing said documents to be stacked in said document unit when said documents are loaded in said document unit while said paper unit is in said loading position, allowing said documents and said printable paper to be stacked in layers when said paper unit moves from said loading position to said feeding position; and a pickup roller disposed to feed said documents and said printable paper into said multi-functional machine through a path provided by a guide plate attached to said frame when said paper unit is in said feeding position, picking up said printable paper stacked beneath said documents after each one of all documents stacked on said printable paper has been picked up by said pickup roller.

2. The apparatus of claim 1, further comprised of a friction pad attached to said guide plate, allowing said documents and said printable paper to be stacked when said protrusion of said lever move away from said document and printable paper stacked by said protrusion of said lever in response to the movement of said paper unit.

3. The apparatus of claim 1, further comprised of said projection pushing said lever to rotate when said paper unit moves in said loading position.

4. The apparatus of claim 1, further comprised of said protrusion blocking said path when said documents are loaded in said document unit so as to stack said documents in said document unit.

5. The apparatus of claim 1, further comprised of a support formed on said frame, supporting said lever rotating in response to the movement of said projection of said paper unit.

6. The apparatus of claim 5, further comprised of said lever having a shaft inserted into a hole formed on said support, said lever rotating about an axis of said shaft.

7. The apparatus of claim 5, further comprised of an extension extended from said support of said lever opposite to said protrusion, said extension contacting said projection of said paper unit.

8. The apparatus of claim 1, further comprised of a elastic member disposed between said paper unit and said frame, allowing said paper unit to move between said loading position and said feeding position.

9. The apparatus of claim 1, further comprised of a cam disposed to rotate, having a curved shape, contacting said paper unit, allowing said paper unit to move between said loading position and said feeding position in accordance with said curved shape.

10. The apparatus of claim 1, wherein said paper unit moves to said feeding position until a portion of the printable paper loaded in said paper unit contacts a portion of the document stacked in said document unit so as to stack the document and the printable paper in layers.

11. A paper feeding apparatus in a multi-functional machine, comprising:

a paper unit disposed in a frame to move between a feeding position and a loading position, accommodating a sheet of printable paper during said loading position;

a document unit disposed on said frame to accommodate a plurality of documents;

a lever disposed on said frame to rotate by the movement of said paper unit;

a protrusion formed on one end of said lever, said protrusion moving toward said documents loaded in said document unit so as to stack said documents in said document unit, allowing said documents to be stacked in said document unit when said documents are loaded in said document unit while said paper unit is in said loading position, allowing said documents and said printable paper to be stacked in layers when said paper unit moves from said loading position to said feeding position; and a pickup roller disposed to feed said documents and said printable paper into said multi-functional machine when said paper unit is in said feeding position, picking up said printable paper stacked beneath said documents after each one of all documents stacked on said printable paper has been picked up by said pickup roller.

12. The apparatus of claim 11, further comprised of said pickup roller feeding said document and printable paper through a path provided by a guide plate attached to said frame.

13. The apparatus of claim 12, further comprised of a friction pad attached to said guide plate, allowing said documents and said printable paper to be stacked in layers when said protrusion of said lever move away from said document and printable paper stacked by said protrusion of said lever in response to the movement of said paper unit.

14. The apparatus of claim 11, further comprised of a projection formed on said paper unit, said projection moving with said paper unit and pushing said lever to rotate when said paper unit moves in said loading position.

15. The apparatus of claim 14, further comprised of a support formed on said frame, supporting said lever rotating in response to the movement of said projection of said paper unit.

16. The apparatus of claim 15, further comprised of said lever having an shaft inserted into a hole formed on said support, rotating about an axis of said shaft.

17. The apparatus of claim 14, further comprised of an extension formed on another end of said lever opposite to said protrusion, contacting said projection of said paper unit.

18. The apparatus of claim 14, further comprised of an opening formed on said frame, said protrusion of said lever protruding through said opening in order to stack the document loaded in said document unit when said paper unit is in the loading position.

19. The apparatus of claim 11, further comprised of a cam disposed to rotate, having a curved shape, contacting said paper unit, allowing said paper unit to move between said loading position and said feeding position in accordance with said curved shape.

20. The apparatus of claim 11, wherein said paper unit moves to said feeding position until a portion of the printable paper loaded in said paper unit contacts a portion of the document stacked in said document unit so as to stack the document and the printable paper in layers.

21. The apparatus of claim 11, wherein said protrusion of said lever moving away from said documents when said paper unit moves from said loading position to said feeding position.

22. A paper feeding apparatus in a multi-functional machine, comprising:

a paper unit disposed in a frame to move between a feeding position and a loading position, accommodating a sheet of printable paper during said loading position;

a document unit disposed on said frame to accommodate a plurality of documents;

a lever disposed on said frame to rotate by the movement of said paper unit, allowing said documents to be stacked in said document unit when said documents are loaded in said document unit while said paper unit is in said loading position, allowing said documents and said printable paper to be stacked in layers when said paper unit moves from said loading position to said feeding position;

a pickup roller disposed to feed said documents and said printable paper into said multi-functional machine when said paper unit is in said feeding position, picking up said printable paper stacked beneath said documents after each one of all documents stacked on said printable paper has been picked up by said pickup roller; and an elastic member disposed between said paper unit and said frame, allowing said paper unit to move between said loading position and said feeding position, pushing said printable paper loaded in said paper unit against said pickup roller.

* * * * *